United States Patent [19]

Brewer

[11] 4,073,232

[45] Feb. 14, 1978

[54] SCREEN PRINTING APPARATUS

[76] Inventor: Harold Hazen Brewer, 21 Peel St. South, Dundas, Ontario, Canada

[21] Appl. No.: 775,689

[22] Filed: Mar. 9, 1977

[51] Int. Cl.[2] ..... B41F 15/26; B41F 15/36

[52] U.S. Cl. ..... 101/126; 101/128.1

[58] Field of Search ..... 101/114, 123, 124, 126, 101/127.1, 128.1, 41, 407 R, 407 BP

[56] References Cited

U.S. PATENT DOCUMENTS

| | | | |
|---|---|---|---|
| 1,665,099 | 4/1928 | Kiesling et al. | 101/407 BP |
| 2,775,194 | 12/1956 | Dubuit | 101/123 |
| 3,098,431 | 7/1963 | Weaver | 101/126 |
| 3,575,106 | 4/1971 | Collins | 101/41 |
| 3,659,523 | 5/1972 | Olsen | 101/123 X |

OTHER PUBLICATIONS

Screen Printing Magazine, p. 9, Apr. 1976; Medalist Ad.

*Primary Examiner*—Ronald E. Suter

*Attorney, Agent, or Firm*—Hirons and Rogers

[57] ABSTRACT

A simple, manually operable screen printing apparatus is provided, which is particularly suitable for small scale, custom printing. The apparatus permits relative adjustment between the printing screen and the workpiece in a side-to-side direction, a forward and backwards direction, a vertical direction and angularly. The apparatus also provides for replacement of the work holder with those of different sizes, to accommodate different sized articles to be printed. In essence, the apparatus comprises a main frame having upright side frame members, printing screen holding arms protruding from the main frame and adjustably mounted on cross-members of the frame for lengthwise adjustment, screen clamps on the holding arms which will releasably and adjustably secure a printing screen to the holding arms for lengthwise and angular adjustment relative to the holding arms, and a work holder on another item of the frame, mounted in a vertically adjustable manner.

10 Claims, 4 Drawing Figures

SCREEN PRINTING APPARATUS

FIELD OF THE INVENTION

This invention relates to screen printing apparatus, and more particularly to screen printing apparatus of relatively small size and simple operation, adapted for screen printing of relatively small sets of articles such as shirts and sweaters.

BACKGROUND OF THE INVENTION

Silk screen printing is an old, well-established and popular process. In essence, it involves the preparation of a screen of cloth, normally fine fibrous nylon or polyester, having a photosensitive layer. The coated screen is exposed to the image of the artwork to be printed. In areas where the photosensitive emulsion is exposed to light, the emulsion cures and renders the screen impermeable to the printing ink composition. In areas protected by the image of the artwork, the emulsion remains uncured and can be washed away. Now the screen can be used to print the image of the artwork, by permitting ink to pass through onto a workpiece in a pattern corresponding to the image produced.

To print with the silk screen so formed, it is usual to mount a workpiece below but separated slightly from the screen, apply printing ink of suitable formulation and consistency to the top of the screen, and brush the ink across the top of the screen by means of a squeegee applicator.

Many screen printing operations are of the small scale, custom order variety. It is necessary that the screen printing apparatus used in such an operation be capable of handling a very large variety of different printing jobs, and that it be readily adjustable from one job to another. Such an apparatus must not only be versatile and readily adjustable in several different senses, but it should also be simple and economical to construct and operate, since the scale of such operations normally does not permit capital expenditures for large, powerdriven, mechanized printing apparatus.

A custom order screen printing operation may be called upon to conduct printing upon widely varying objects. For example, it may be necessary to print a repeating pattern upon a set of textiles, for example sports team uniforms. Such a set of articles is small in number, but nevertheless may require fairly intricate printing patterns, e.g. team crests and insignia and sometimes involving multiple colours. The same operation may also be called upon to print upon three-dimensional objects of substantial thickness, such as hockey pucks. It is desirable that a small printing operation have a single machine with sufficient versatility to handle all of such operations.

BRIEF DESCRIPTION OF THE PRIOR ART

Various forms of screen printing apparatus have been described in the past, some of which have included means for adjusting and registering the screen and the workpiece relative to each other, for printing accuracy. For example, U.S. Pat. No. 3,943,851 Inada et al describes a screen setting device by means of which the screen can be set in correct position with respect to sheet material to be printed. U.S. Pat. No. 3,486,441 Hillman describes an apparatus for precision coating articles by silk screen printing, embodying a movable work table for adjustably mounting the work piece below the screen, with power actuation of the various moving parts. U.S. Pat. No. 3,946,668 Douthwaite et al discloses a relatively complicated, power-driven printing machine having a special linkage connecting the screen support and printing bed support to move the screen into and out of its operative position. However, none of such prior art proposals shows a simple but versatile screen printing apparatus which can be economically constructed and used on a small scale, for printing of a wide variety of different shapes and sizes of objects. They are not suited to perform, in a simple and economical manner, the many and varied tasks which a small, non-specialized custom silk screen printing operation is called upon to accomplish.

SUMMARY OF THE INVENTION

It is an object of the present invention to provide a novel silk screen printing apparatus which is simple and versatile.

It is a further object to provide a silk screen printing apparatus which is economical to build and operate, and which provides several degrees of adjustment of printing screen and work piece.

A further object is to provide a screen printing apparatus which is particularly suitable for use in a small, custom order type operation, and which has sufficient versatility to handle the types of printing task encountered in such an operation.

According to the present invention, there is provided a screen printing apparatus comprising a main frame having upright side frame members, an upper cross member and an intermediate cross member, with at least one printing screen holding arm protruding from the main frame and being adjustably mounted on the upper cross member for lengthwise adjustment therealong. There is provided screen clamping means on the holding arm, adapted to releasably and adjustably secure to the holding arm a printing screen for adjustment lengthwise and angularly with respect to the holding arm. There is also provided work holding means secured to the intermediate cross member of the main frame, and adapted to releasably clamp thereto a workpiece holding member, in a fixed angular position relative to the main frame.

The apparatus of the invention provides for relative adjustment between the work piece and the printing screen, not only in a side-to-side sense and a forward and backwards sense, with respect to the frame, but also angularly. This is accomplished in a simple, economical manner, by arrangements for adjustably mounting the screen. By use of this apparatus, one can print an accurately repeating pattern upon different areas of a work piece such as a hockey sweater, from a screen on which the artwork comprises only the single pattern element, by adjustment of the screen without removing the workpiece from its holder. One can also prepare a screen having different images spaced about its area, and print these different images in registry with one another on a single workpiece, without removing the workpiece from its holder, merely by adjustment of the screen relative to the workpiece. In this way, complicated, multi-coloured designs such as team crests can be printed from a single screen, in a rapid, efficient manner, without requiring removal and re-positioning of the workpiece.

DESCRIPTION OF THE PREFERRED EMBODIMENTS

Preferably, the apparatus of the invention includes two printing screen holding arms, each having an associated screen receiving element. The holding arms are each adjustably mounted on the upper cross member of the main frame, for lengthwise adjustment therealong independently of each other, and for adjustment in a vertical plane, angularly about the axis of the upper cross member, independently of one another.

In a preferred embodiment, each of the holding arms has a slotted aperture extending lengthwise thereof, and there is provided a clamp extending through the aperture to engage the screen receiving element located below the holding arm. The clamp is slidable and pivotable in the aperture to permit lengthwise and angular adjustment of the screen receiving element relative to the holding arm, and is also tightenable to secure the screen receiving element to the holding arm in preadjusted relative position. Further, the screen receiving elements may be of channel section, the opening to the channel being presented downwardly, and with clamps therein protruding through one side of the channel section, so as to secure the side members of the printing screen frame within the channel section members.

An especially preferred embodiment includes a workpiece holding member associated with the work holding means, the workpiece holding member having a flat upper surface and a downwardly extending leg, the work holding means comprising an upstanding bracket with an upwardly presented aperture therein and horizontally extending clamping means protruding into the aperture. The downwardly extending leg of the workpiece holding member is received in the aperture and releasably secured therein by the clamping means, at a preadjusted height, thereby permitting adjustment of the height of the upper surface of the workpiece holding member relative to the main frame, and thereby accommodating articles of different thicknesses for printing purposes. Also, the workpiece holding member may comprise at least one flat, board-like element, the top surface of which constitutes the flat horizontal upper surface, the downwardly extending leg of the workpiece holding member being separable from the board-like element. Such an arrangement permits ready inter-changing of workpiece holding members, for accommodation of different sized work pieces, such as shirts or sweaters of different sizes, sweater sleeves, etc. It also permits printing of articles of different thicknesses, by height adjustment between the screen and the workpiece holder. Thus, articles as thin as paper sheets and as thick as footballs can be printed on this apparatus.

BRIEF DESCRIPTION OF THE DRAWINGS

The above will be further apparent from a consideration of the accompanying drawings and specific description of the presently preferred specific embodiment of the invention, given here for illustrative but not limitative purposes.

In the accompanying drawings.

In the drawings, like reference numerals indicate like parts.

DESCRIPTION OF THE SPECIFIC PREFERRED EMBODIMENT

Figure 1:
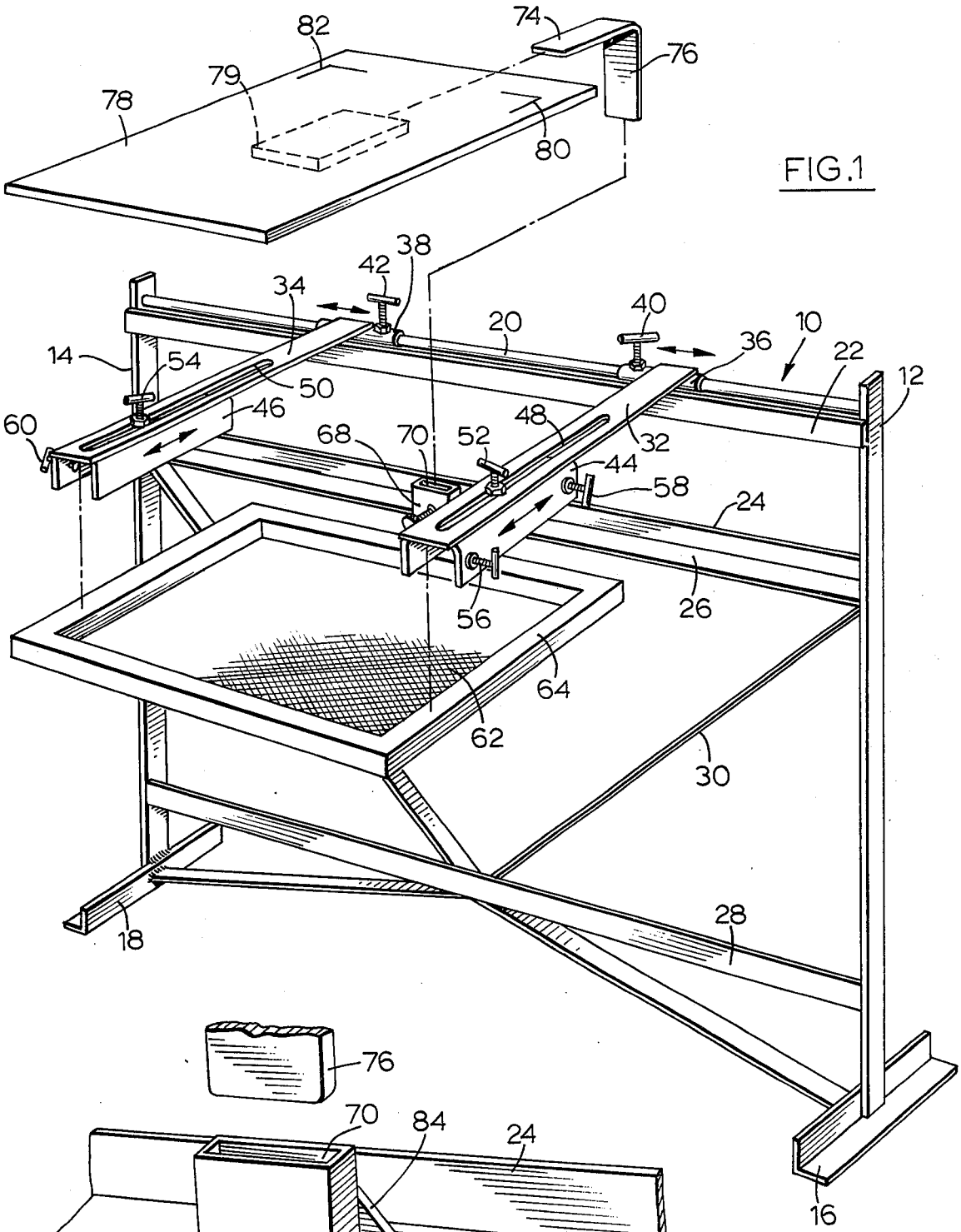
FIG. 1 is an exploded perspective view of an apparatus according to the invention.

With reference to FIG. 1 of the accompanying drawings, apparatus according to the invention comprises a main frame 10 having a pair of upright flat section side frame members 12, 14, the bottom ends of which are welded to respective base members 16, 18. The frame 10 has an upper cross member 20 of circular cross-section, an upper cross bar 22 of rectangular cross-section, located forwardly of and at approximately the same height as cross member 20, an intermediate angle section cross member 24 with a forwardly presented horizontal surface 26, and a bottom cross member 28 of rectangular cross section. All of the various cross members 20, 22, 24 and 28 are rigidly secured to the side frame members 12, 14 as by welding. Various diagonally extending strengthening struts such as 30 are additionally provided, welded to other frame members.

There are provided two printing screen holding arms 32, 34 protruding forwardly from the frame 10. At their rearward ends, they are provided with integral cylindrical formations 36, 38 through which the circular section upper cross member 20 passes, so that arms 32, 34 are slidable lengthwise along the cross member 20, and pivotable in a vertical plane up and down about the axis of cross member 20. These cylindrical formations 36, 38 are provided with releasable clamping means in the form of screw threaded clamping bolts 40, 42 respectively, manually operable to tighten onto cross member 20 so as to clamp arms 32, 34 in preadjusted position. The pivotal movement of the arms 32, 34 about cross member 20 is limited in the downward direction to a substantially horizontal position of arms 32, 34, by engagement of the arms 32, 34 with the top edge of cross bar 22.

Each arm 32, 34 is provided with a respective channel-shaped screen receiving element 44, 46, presented downwardly from the bottom surface of the respective arm. Each arm 32, 34 has a respective elongated slotted aperture 48, 50 extending lengthwise therein, the screen receiving elements 44, 46 being attached to the arms 32, 34 by respective screw threaded bolt clamps 52, 54. When the clamps 52, 54 are loosened, they can be moved forwardly and backwardly along slots 48, 50 so as to adjust screen receiving elements 44, 46 relative to arms 32, 34. The elements 44, 46 can also be pivoted on clamps 52, 54 relative to arms 32, 34. The clamps 52, 54 can then be tightened manually to secure the elements 44, 46 in preadjusted position relative to arms 32, 34.

The outer webs of channel section screen receiving elements 44, 46 are provided with lateral screw clamps 56, 58, 60, etc. A printing screen of conventional form, having a textile screen 62 and an upstanding frame 64 can thus be releasably clamped to the apparatus, the side members of its frame 64 being received in the channel section screen receiving elements 44, 46 and releasably clamped therein by manually tightening screw clamps 56, 58, 60, etc.

Figure 2:
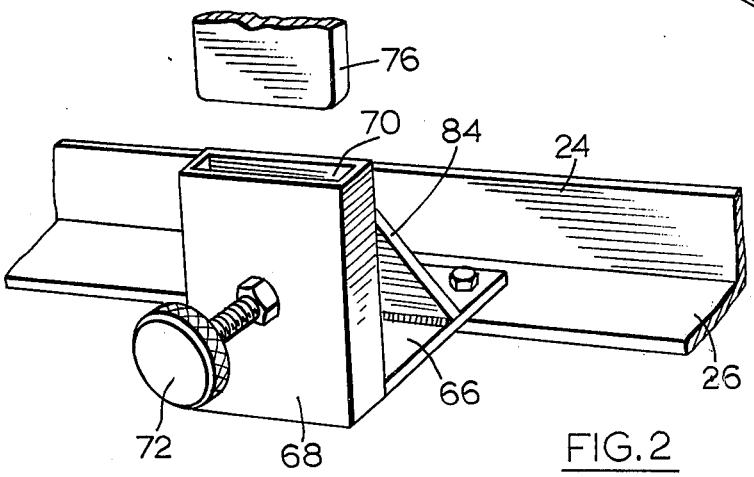
FIG. 2 is a perspective view of the workpiece mounting arrangement of the apparatus of FIG. 1.

The horizontal surface 26 of intermediate cross member 24 has rigidly secured thereto, near its mid point, a work holding means in the form of a bracket with a horizontal web 66 bolted to surface 26 and an upstanding sleeve 68 with a rectangular section aperture 70 extending vertically therethrough. This is best seen in FIG. 2. A clamping means in the form of a screw threaded bolt 72 protrudes into the aperture 70. The work piece holding member is associated with this bracket 66, 68, this member consisting of an angle bracket with an upper web 74 and a downwardly extending leg 76, and a pallet board 78 with a smooth upper surface. The lower surface of the pallet board 78 has a horizontally extending sleeve 79 thereon, in which upper web 74 of the angle bracket is a close sliding fit. The leg 76 is dimensioned so as to be a sliding fit within aperture 70 of sleeve 68. The leg 76 can thus be releasably clamped by bolt 72 at a preadjusted height within sleeve 68, so as to adjust the height of pallet board 78 which bears work to be printed. On its upper surface, pallet board 78 bears indicia marks 80, 82, so assist in correct positioning of work thereon. A diagonal strengthening strut 84 is provided extending between sleeve 68 and horizontal web 66 of the work holding means.

Figure 3:
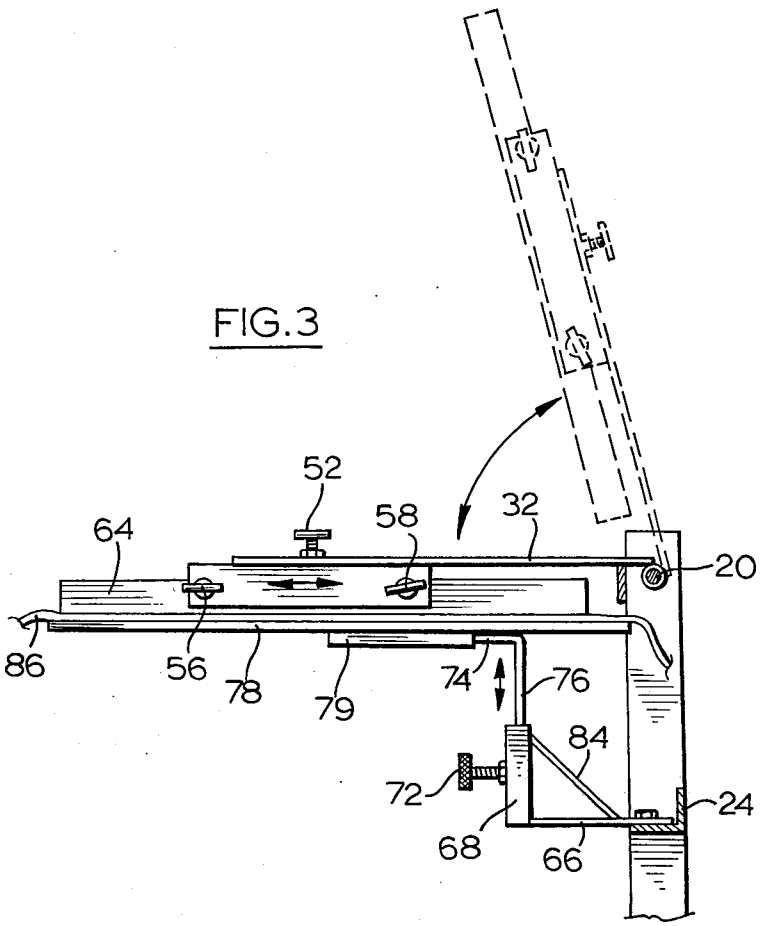
FIG. 3 is a side view of the upper part of the apparatus of FIG. 1.
Figure 4:
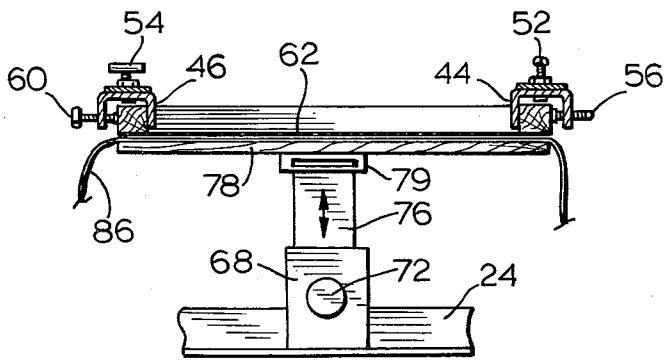
FIG. 4 is a front view of a detail of the apparatus, largely corresponding to FIG. 3.

FIGS. 3 and 4 illustrate the apparatus described above in operation. The work piece 86 to be printed, e.g. a T-shirt or sweater, is mounted on pallet board 78 in the correct position. Then the pallet board 78 bearing the workpiece 86 is mounted on upper web 74 of the angle bracket. The depending leg 76 of the angle bracket is then inserted into aperture 70 of bracket 66, 68, and fixed therein at the correct height by tightening bolt 72. Pallet board 78 now comprises a work table for the workpiece 86.

With the arms 32, 34 in the raised position, as shown in ghosted outline in FIG. 3, the printing screen 62, with the artwork thereon, is now mounted on the arms. For this purpose, bolts 40, 42 are loosened so as to adjust arms 32, 34 lengthwise along the top cross-member 20, to the correct separation to receive the periphery 64 of screen 62 in channel members 44, 46. Then clamps 56, 58, 60 etc. are tightened to retain the screen 62 therein.

Next, the arms 32, 34 and screen 62 are lowered about cross-member 20, to bring the screen 62 into printing position over workpiece 86, i.e. to the full line position shown in FIG. 3, and also shown in FIG. 4. Then clamps 52, 54 and bolts 40, 42 are maintained in a loosened position, and screen 62 is adjusted forwardly, sideways or angularly as required, so that its artwork is positioned as desired relative to the workpiece 86. Then ink is brushed across screen 62 to effect the necessary printing.

After one such garment has been printed, another similar one can be printed with an identical pattern, in the same location, from the same screen 62. The screen 62 and arms 32, 34 are raised slightly, care being taken not to move the arms lengthwise along cross-member 20 whilst raising them. Bolt clamps 52, 54 are maintained tightly secured, so that the screen 62 does not move relative to the pallet board 78. Then workpiece 86 is withdrawn off pallet board 78 and replaced by another one, lined up with indicia 80, 82 on the pallet board 78 in the same manner as for the first workpiece. Now the printing operation is repeated, to print the second workpiece identically to the first. In this manner, a set of identically printed articles such as team sweaters can be screeen printed.

The same screen 62 may have a variety of different items of artwork printed thereon, at different locations on the screen, for printing on the same set of workpieces at a predetermined location on each one. After printing the first items on the entire set in the manner described above, the screen 62 is then reset lengthwise, forwardly and rearwardly, and angularly, to print a second of the items of artwork on the workpieces at a given location thereon. The screen is maintained in this position whilst all the workpieces are printed with this second, repeating pattern, care being taken to position the workpieces properly and substantially identically on the pallet board 78 with reference to its indicia 80, 82. It will be appreciated that the upper surface of pallet board 78 is smooth, and preferably resin-covered with a hard, polished surface.

In this way, the apparatus can be used to print articles with repeating patterns made up of several components but of intricate final design, e.g. multicoloured pictures and designs. These can be done using a single printing screen on which several items of artwork, to be composited into a design, are formed on a single screen, in different areas thereof. One single screen preparation is therefore necessary instead of several, which is a substantial saving of time, labor and materials.

It will be appreciated that the pallet board 78 which acts as the work table surface is readily and simply replaceable with other similar boards of different sizes and shapes, so as better and more accurately to print articles mounted thereon. For proper registration of the pallet board and the work piece, it is best that the size of the pallet board be chosen so as to fit the workpiece, especially in the case of printing textile garments such as shirts and sweaters. The apparatus of the invention enables pallet boards to be removed and interchanged rapidly and simply.

Figure 5:
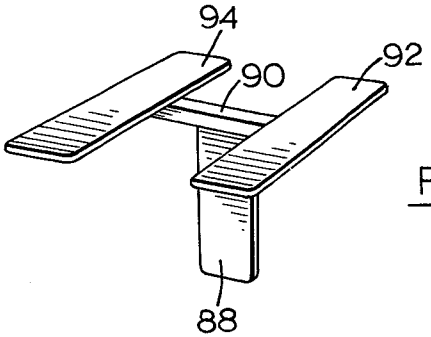
FIG. 5 is a perspective view of an alternative workpiece holder for use with the apparatus of FIGS. 1 – 4.

A specific example of a different type of workpiece holding member is illustrated in FIG. 5. In this embodiment, a downwardly extending leg 88 is provided for reception in the aperture 70 of the work holding means 66, 68 and adjustably clamped therein. The leg 88 is welded to a lateral arm 90 which carries, at each end, a forwardly projecting narrow board 92, 94 respectfully. The narrow boards 92, 94 are designed to receive the two sleeves of a garment such as a sweater or shirt for printing thereon. It is often necessary to print a team insignia or other design in repeating fashion, on a set of sports' uniforms. The apparatus of the invention accomplishes this using the workpiece holding member of FIG. 5. The screen may either be printed with the designs in two spaced apart locations to print on both sleeves simultaneously, or alternatively may be adjusted as previously described to print on the two sleeves successively, from a single image.

It will be appreciated that the above description is illustrative only and is not to be construed as limiting. Other embodiments may be adopted without departing from the scope and spirit of the invention. The invention is limited only by the scope of the appended claims.

I claim:

1. A screen printing apparatus comprising;

a main frame having upright side frame members, an upper cross member and an intermediate cross member;

a pair of printing screen holding arms protruding from the main frame and adjustably mounted on said upper cross member for lengthwise adjustment therealong;

screen clamping means on each of said holding arms releasably and adjustably securing to said holding arms a printing screen for adjustment lengthwise and angularly with respect to the holding arms;

work holding means secured to the intermediate cross member of the main frame;

a workpiece holding member releasably clamped to the work holding means in fixed angular position relative to the main frame, said workpiece holding member having an upper surface and a downwardly extending leg;

said work holding means comprising an upstanding bracket with an upwardly presented aperture therein and horizontally extending clamping means protruding into said aperture;

the downwardly extending leg of the workpiece holding member being received in said aperture and releasably securable therein by said clamping means at preadjusted height, so as to permit adjustment of the height of the upper surface of the workpiece holding member relative to the main frame.

2. Apparatus of claim 1 wherein said screen clamping means each comprise a screen receiving element with at least one clamp therein to releasably engage a printing screen, said screen receiving elements being slidably and pivotally mounted on the respective holding arms.

3. Apparatus of claim 2 wherein each said holding arm is adjustably mounted on said upper cross member of the main frame, for independent lengthwise adjustment therealong and for independent adjustment in a vertical plane, angularly about the axis of the upper cross member.

4. Apparatus of claim 3 including releasable clamping means on each of said printing screen holding arms, engageable with the upper cross member to secure the arms in fixed, preadjusted positions on the upper cross member.

5. Apparatus according to claim 3 including stop means secured to the main frame, engaging and supporting the printing screen holding arms in a generally horizontal, forwardly extending position, and limiting the extent of downward angular adjustment of the holding arms to said generally horizontal position.

6. Apparatus of claim 2 wherein each of said holding arms has a slotted aperture extending lengthwise thereof, and in which a clamp extends through the aperture to engage the screen receiving element located below the holding arm, said clamp being slidable and pivotable in said aperture to permit lengthwise and angular adjustment of the screen receiving element relative to the holding arm, and tightenable to secure the screen receiving element to the holding arm in preadjusted relative position.

7. The apparatus of claim 6 wherein said screen receiving elements are of channel section, the opening to the channel being presented downwardly, with the clamps therein protruding through one side of the channel section.

8. Apparatus of claim 1 wherein the workpiece holding member comprises at least one flat, board-like element, the top surface of which constitutes a flat horizontal upper surface, the downwardly extending leg of the workpiece holding member being separable from said board-like element.

9. Apparatus according to claim 8 wherein said board-like element has indicia on its flat horizontal upper surface, for registration with a workpiece.

10. Apparatus of claim 1 wherein the workpiece holding member comprises a pair of side by side, spaced apart board-like elements with said downwardly extending leg affixed thereto and received and clamped at an adjustable height in the aperture of the upstanding bracket of said work holding means.

* * * * *